United States Patent [19]

Gogniat et al.

[11] Patent Number: 4,518,093

[45] Date of Patent: May 21, 1985

[54] WATCH CASE

[76] Inventors: Paul Gogniat, Chemin de la Prévote 14, 2504 Bienne; Eric Loth, Tiefenmattweg 40, 2500 Bienne, both of Switzerland

[21] Appl. No.: 610,418

[22] Filed: May 15, 1984

[30] Foreign Application Priority Data

May 19, 1983 [CH] Switzerland ..... 2743/83

[51] Int. Cl.[3] ..... G04B 37/00

[52] U.S. Cl. ..... 220/82 R; 368/294; 368/296

[58] Field of Search .....: 220/82 R, 82 A, 67, 220/75, 89 B; 368/294, 295, 296, 309

[56] References Cited

U.S. PATENT DOCUMENTS

| | | | |
|---|---|---|---|
| 3,137,385 | 6/1964 | Levesque | 220/67 X |
| 4,408,900 | 10/1983 | Takasugi et al. | 368/296 X |
| 4,433,921 | 2/1984 | Gogniat et al. | 368/296 X |

*Primary Examiner*—Steven M. Pollard

[57] ABSTRACT

A watch case is described comprising a glass soldered to a metal part. The area of the glass having to be soldered to the metal part is provided with a coating which includes at least an outer layer made of the same material as the metal part.

4 Claims, 1 Drawing Figure

WATCH CASE

BACKGROUND OF THE INVENTION

1. Field of the Invention

This invention relates to a watch case and more particularly to a watch case having a glass soldered to a metal part of the case, as for instance a bezel or a middle.

2. Prior Art

Such a watch case is for instance disclosed in European Patent Specification No. 0066538 which teaches applying, beneath the glass, over the area thereof intended to be soldered to the metal part of the case, a particular form of metal coating. This coating is made up of different superposed layers, i.e. a first, masking, layer, e.g. of gold, chromium or nickel, for safeguarding the aesthetic appearance of the case by masking the solder area, a second, barrier, layer, e.g. of chromium, for preventing the weld material from diffusing towards the glass and spoiling the appearance of the masking layer, and a third, final, layer, e.g. of copper or gold, for ensuring a proper bonding of the solder material to the coating thus formed beneath the glass.

Such a structure has proved to be particularly effective in the production of aesthetic watch cases involving the soldering of a glass at low temperature to a metal part. By low temperature soldering is meant soldering resorting to the use of a filler material, e.g. a silver or tin alloy, having a melting temperature below 550° C. and preferably between 180° and 250° C. The mechanical resistance of such assemblies is excellent, the wrenching force being in the region of 6 kg/mm$^2$.

However, in some applications an even better mechanical resistance is required, i.e. a wrenching force of 15 kg/mm$^2$ is more. In such cases the assemblies necessitate high temperature soldering, i.e. involving the use of a filler material having a high melting point, e.g. 600° C. or more, of the kind commonly used in, for instance, the soldering of steel parts. To produce such assemblies, coatings of the kind set forth above are no longer appropriate, in particular because of the strains caused by the high temperature reached during soldering.

SUMMARY OF THE INVENTION

An object of the invention is to provide a watch case of the kind set forth, but in which the metal coating is adapted also to enable soldering at high temperatures.

The watch case provided by the invention comprises a metal part and a glass soldered to the metal part, said glass having a metal coating thereon over the area thereof soldered to the metal part, said metal coating including an outer layer of a material similar to that of the metal part.

By using similar, and preferably identical or substantially identical, materials for the metal coating and metal part, the coefficients of expansion of the metal coating and metal part can be matched. Preferably, the metal coating and metal part are of stainless steel.

To enable the tensions that are set up during soldering to be absorbed, an intermediate layer of malleable material may be provided beneath the outer metal layer and over an initial masking layer, such intermediate layer having a thickness of a few microns to several tenths of a millimeter. The preferred materials for the intermediate layer are gold, copper and copper based alloys, which are all easily deformable. This intermediate layer also helps to protect the masking layer during application of the outer layer and to ensure proper bonding of the outer layer.

BRIEF DESCRIPTION OF THE DRAWING

The single FIGURE of the accompanying drawing shows part of a watch case, partly in cross-section, constructed in accordance with the invention.

DETAILED DESCRIPTION

Figure 1:
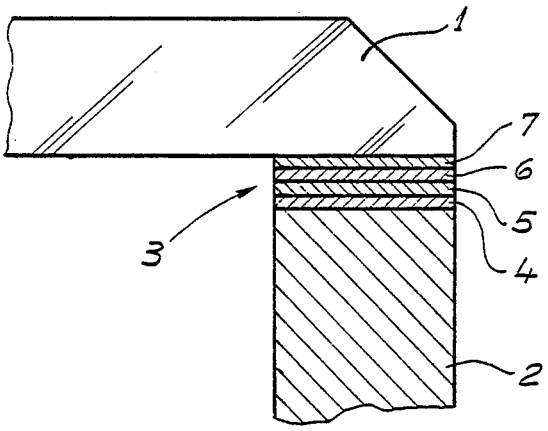

The watch case partly shown in the single FIGURE of the drawing comprises a glass 1, for instance made of sapphire, soldered to a metal part 2 such as a watch middle or a bezel. In the region where it is soldered to the metal part 2, the glass 1 is provided with a metal coating 3. The metal coating 3 thus extends between the glass 1 and a layer of solder 4 which comes into direct contact with the metal part 2.

The coating 3 includes an outer layer 5 made from the same material as part 2. Preferably this common material is a stainless steel; that corresponding to AISI 304 is particularly suitable for this. Beneath the outer layer 5, which may have a thickness ranging from a few microns to several tenths of a millimeter, is provided an intermediate layer 6 of malleable material also having a thickness of a few microns to several tenths of a millimeter, e.g. 100 μm. The malleable material preferably consists of gold, or, to reduce overall costs, copper or a copper based alloy. This material itself overlies a masking layer 7 of known kind, for instance of gold, chromium or nickel. The thickness of this masking layer is less than one micron and is preferably of about 0.2 μm.

The above described watch case may for example be produced as follows. The glass is here made of sapphire and is to be soldered to a bezel made of AISI 304 stainless steel.

The glass is inserted in a vacuum chamber, after having first protected its central portion so as only to leave a peripheral region of its underside exposed. Once the chamber has been evacuated, a length of chromium wire is vaporized by a Joule effect to apply on the glass a masking layer of chromium having a thickness of 0.2 μm and which forms a good bond with the glass. Within the same evacuated chamber, a layer of copper, 100 μm thick, is then deposited over the chromium layer by sputtering, using an interchangeable copper target. The bonding of this intermediate layer to the masking layer is improved by a diffusion heat treatment, also performed in the evacuated chamber, which involves raising the temperature of the glass to a temperature of from 400° to 600° C. for 20 minutes. The copper target is then replaced by an interchangeable target of AISI 304 steel and a new sputtering operation is performed in the evacuated chamber until the resulting outer layer of steel applied over the intermediate layer reaches a thickness of 0.3 mm.

Once provided with its metal coating, the glass is removed from the chamber and is placed on the bezel after first interposing a high temperature soldering material in a solid state, e.g. in the form of short lengths of wire or grains. The resulting assembly is put in an oven, e.g. having a controlled atmosphere, is heated to the melting temperature of the soldering material, and is then cooled.

In a modified form of the above method, the glass is metallized in a conventional chamber, by vacuum evaporation, so as to deposit a properly adhering layer, e.g. of nickel, gold or chromium, that is visible from outside the case, with the layer forming for instances beads or fillets or decorative patterns. Over this layer an unoxidyzable layer, about 0.2 μm thick, of gold is then deposited, by vacuum evaporation also. The glass is then removed from the chamber, treated to protect the surface thereof that does not need coating, and has galvanically applied thereto, over the previously applied layer, a layer of copper having a thickness of about 0.5 mm which is then subjected to a diffusion heat treatment for 20 minutes at 420° C. Finally, the glass is put in a suitable physical vapor deposition chamber and a layer of stainless steel, 0.5 mm thick, is applied by sputtering over the layer of copper.

We claim:

1. A watch case which comprises a metal part and a glass soldered to the metal part, said glass having a metal coating thereon over the area thereof soldered to the metal part, said coating including an outer layer of a material similar to that of the metal part.

2. A watch case as in claim 1, in which the metal part and the coating are of stainless steel.

3. A watch case as in claim 1, in which the metal coating includes, beneath the outer layer, an intermediate layer of malleable material.

4. A watch case as in claim 3, in which the malleable material is selected from gold, copper or copper based alloys.

* * * * *

UNITED STATES PATENT AND TRADEMARK OFFICE

CERTIFICATE OF CORRECTION

PATENT NO. : 4,518,093

DATED : May 21, 1985

INVENTOR(S) : Gogniat et al.

It is certified that error appears in the above-identified patent and that said Letters Patent is hereby corrected as shown below:

--Assignee: Montres Rado S.A., Lengnau, Switzerland--

Signed and Sealed this

*Second* Day of *September 1986*

[SEAL]

*Attest:*

*Attesting Officer*

DONALD J. QUIGG

*Commissioner of Patents and Trademarks*